US010322599B1

(12) United States Patent
Stimac

(10) Patent No.: US 10,322,599 B1
(45) Date of Patent: Jun. 18, 2019

(54) GREETING CARD WITH GIFT CARD HOLDER POUCH

(71) Applicant: American Greetings Corporation, Cleveland, OH (US)

(72) Inventor: Barbara Stimac, North Royalton, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/924,227

(22) Filed: Mar. 18, 2018

(51) Int. Cl.
*B42D 15/02* (2006.01)
*B42D 15/04* (2006.01)

(52) U.S. Cl.
CPC ..... *B42D 15/045* (2013.01); *B42D 15/022* (2013.01)

(58) Field of Classification Search
None
See application file for complete search history.

(56) References Cited

U.S. PATENT DOCUMENTS 6,640,974 B2 * 11/2003 Malone ..... A45C 11/182 206/449
7,861,441 B1 * 1/2011 Hoellwarth ..... B42D 15/08 229/92.8
9,460,580 B1 * 10/2016 Glass ..... G07F 7/1008
2004/0181980 A1 * 9/2004 Gardi ..... B42D 15/045 40/124
2004/0187368 A1 * 9/2004 Foster ..... G09F 1/04 40/124.06
2007/0256337 A1 * 11/2007 Segan ..... B42D 15/045 40/124.03
2009/0314668 A1 * 12/2009 Miller ..... B42D 15/022 206/223
2011/0126437 A1 * 6/2011 Bullington ..... B42D 15/045 40/124.06
2014/0284238 A1 * 9/2014 Clinton ..... B65D 85/60 206/457

* cited by examiner

*Primary Examiner* — Kristina N Junge
(74) *Attorney, Agent, or Firm* — Christine Flanagan

(57) ABSTRACT

A greeting card body having an integral pouch into which a gift card or other item may be inserted and removed. The greeting card may additionally contain sound capabilities or other special effects.

20 Claims, 5 Drawing Sheets

GREETING CARD WITH GIFT CARD HOLDER POUCH

RELATED APPLICATIONS

There are no applications related to this application.

FIELD OF THE INVENTION

This invention is in the field of social expression products and is more specifically directed to greeting cards with integral gift card holders.

SUMMARY OF THE INVENTION

In one embodiment, the greeting card of the present disclosure and related inventions, includes a greeting card body, a portion of the greeting card body having an aperture therethrough and a pouch attached to the rear surface of the opening on the greeting card body, creating an open cavity.

In another embodiment, the greeting card includes a greeting card body having a front surface, an inside left surface, an inside right surface and a rear surface, an aperture which extends through the front and inside left surface of the greeting card body, a pouch attached around the aperture beneath the inside left surface of the greeting card body, a sound module contained within the greeting body, the sound module operative to store and playback at least one audio file, and a switch contained within the greeting card body, the switch operative to control activation of the sound module.

In another embodiment, the greeting card contains a greeting card body having an aperture contained through at least a portion thereof, a pouch attached to a rear surface of the aperture, and a sound module contained within the greeting card body, the sound module operative to store and playback at least one audio file, wherein reaching into the pouch activates the sound module.

DETAILED DESCRIPTION OF PREFERRED AND ALTERNATE EMBODIMENTS

Figure 1:
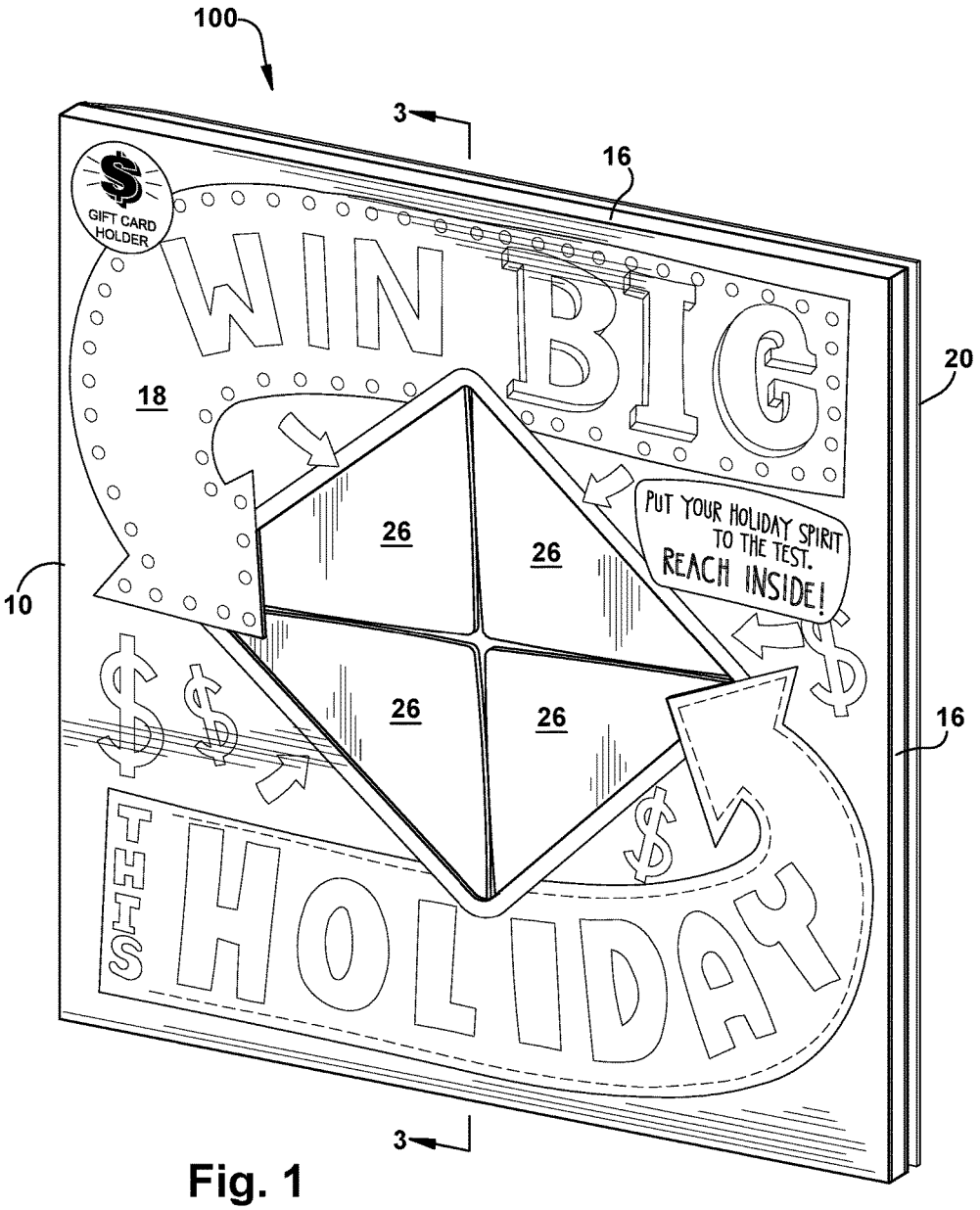
FIG. 1 is a front perspective view of the Greeting Card with Gift Holder Pouch of the present invention.

The greeting card 100 of the present disclosure and related invention includes a greeting card body 10 having an integral pouch 12 into which a gift card 14 may be inserted and removed. The greeting card 100 may additionally contain sound capabilities or other special effects.

The greeting card body 10 may include a foam core (interchangeably referred to as "the core") 16 which serves as the center or core of the greeting card 100. While the core 16 will be described herein as being made of foam, other materials have been contemplated and are considered to be within the scope of this invention. The core 16 contains a front surface, a rear surface and a perimeter surface which extends between the front and rear surfaces. In one embodiment, the front and rear surfaces of the core are substantially planar. The core 16 may contain one or more compartments, openings, apertures, pockets or cavities therein. The core 16 may also be covered with a sheet material 18. In one embodiment, the sheet material 18 covers the entire outer surface of the core 16 with a sentiment panel 20 attached along one edge to the sheet material 18 covering the rear surface of the core 16. The sentiment panel 20 may have greeting card sentiment printed thereon or provide a place wherein a user may sign his/her name or write a personal note to the greeting card recipient. In other embodiments, the sheet material 18 may only cover a portion of the core 16, such as the front and rear surfaces, the front surface only, or any other combination thereof, or the core 16 may remain completely uncovered. The sheet material 18, in one embodiment, may be made of paperboard, however, other materials may be used. In one embodiment, as shown in the figures, the sheet material 18 attached to the front surface of the core 16 serves as the front panel or cover of the greeting card 100. The sheet material 18 attached to the rear surface of the core 16 serves as the inside left panel of the greeting card. A front surface of the sentiment panel 20 serves as the inside right panel of the greeting card 100 and the rear surface of the sentiment panel 20 serves as the rear or back cover of the greeting card 100. The sheet material 18 and sentiment panel 20 may be contiguous, or they may be separate and attached via glue, staples, or any other attachment device or mechanism. In one embodiment, the sheet material 18 and sentiment panel 20 are made of the same material, such as paperboard. In other embodiments, they may be made of different materials. The sheet material 18 and sentiment panel 20 may have printing thereon, such as text, photos, pictures, drawings, or any other printable matter. Additional embellishments may be applied as well, such as googly eyes, gems, faux fur, etc. The greeting card 100 is opened and closed by pivoting the sentiment panel 20 away from and towards the core 16 of the greeting card 100.

Figure 2:
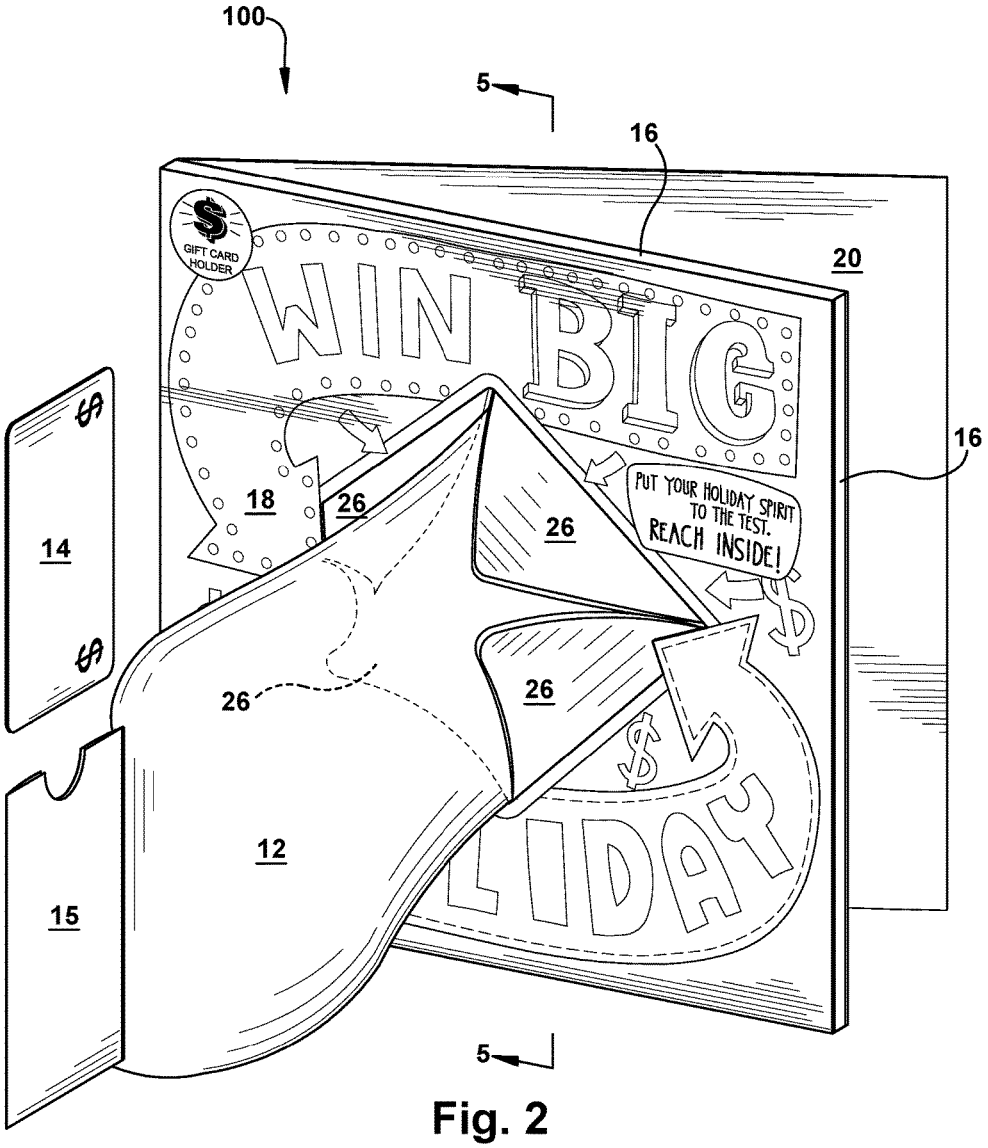
FIG. 2 is a front perspective view of the Greeting Card with Gift Card Holder Pouch of FIG. 1, with pouch turned inside out.
Figure 4:
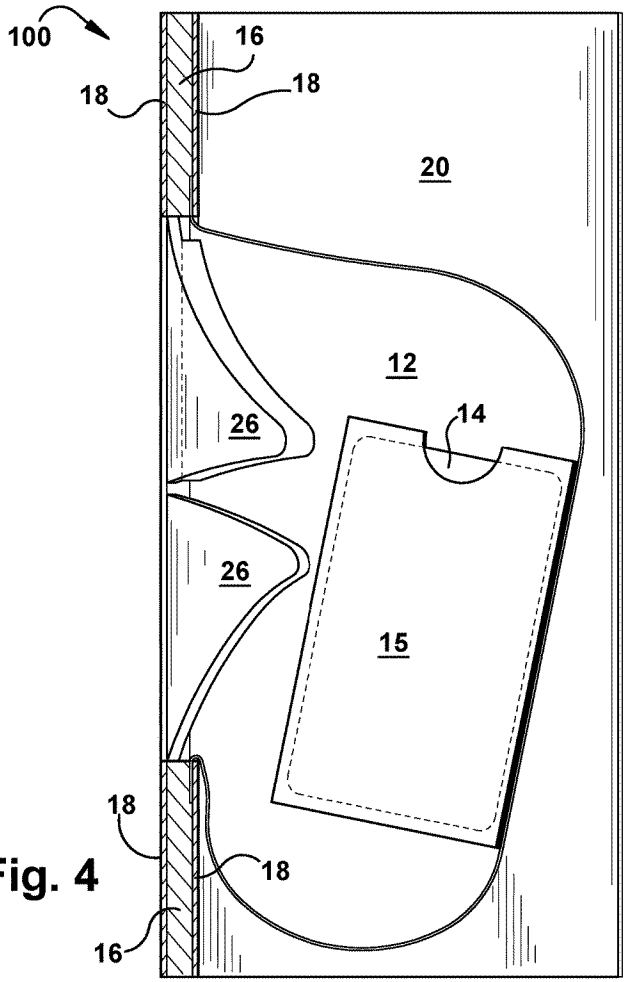
FIG. 4 is a right side cross-sectional view of the Greeting Card with Gift Card Holder Pouch
Figure 3:
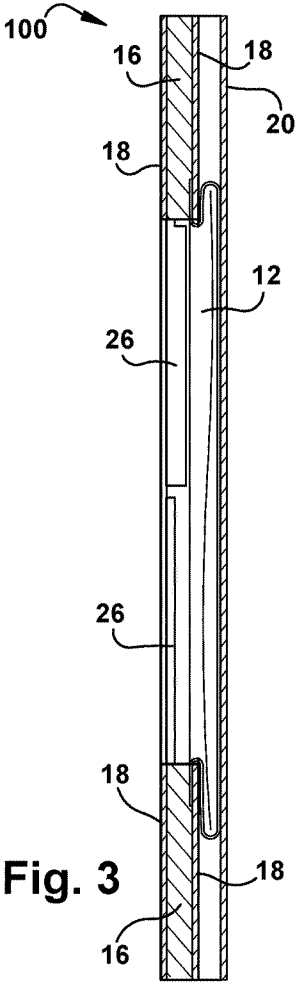
FIG. 3 is a right side cross-sectional view of the Greeting Card with Gift Card Holder Pouch of FIG. 1, from the perspective of arrows 3-3.
Figure 5:
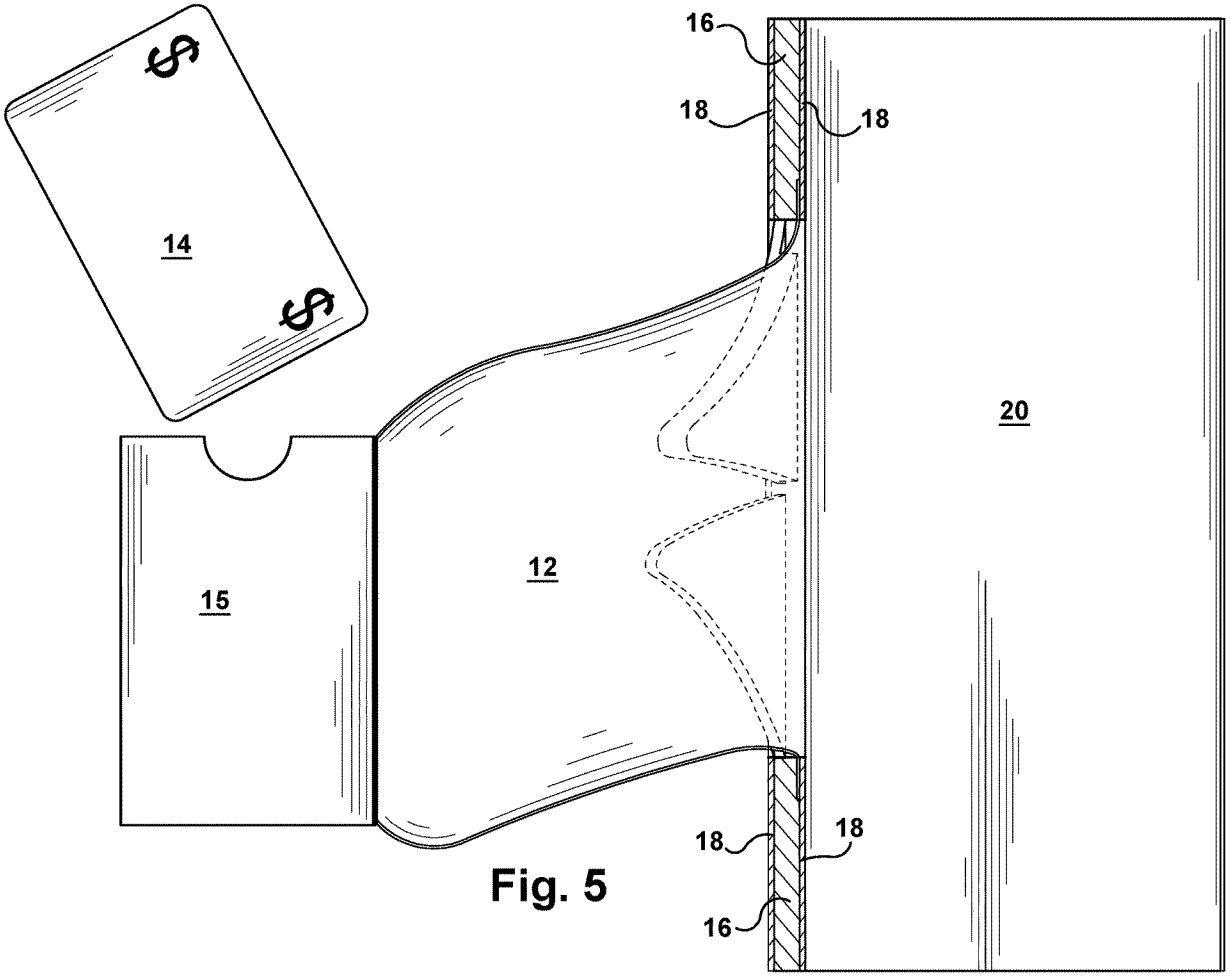
FIG. 5 is a right side cross-sectional view of the Greeting Card with Gift Card Holder Pouch of FIG. 2
Figure 6:
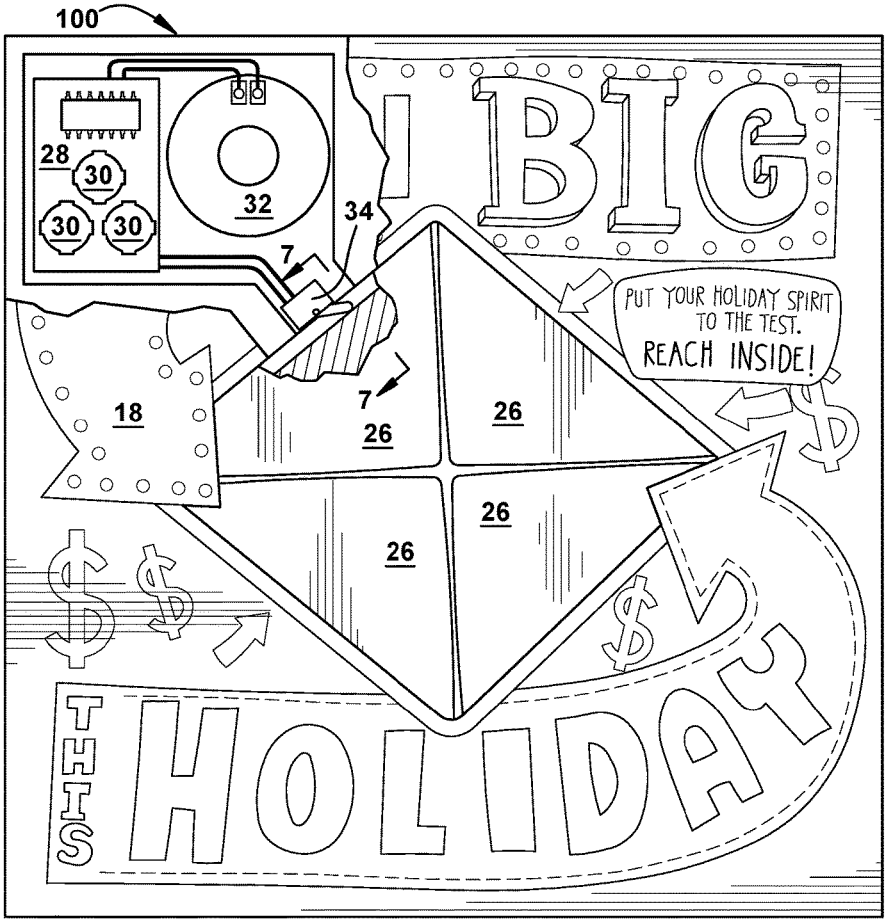
FIG. 6 is a front partial tear-away view of the Greeting Card with Gift Card Holder Pouch of FIG. 1.

In one embodiment, the core 16 (and sheet material 18 covering at least a portion of the core) contains a main opening or aperture 22 which extends therethrough. The core 16 may also contain one or more minor openings or apertures wherein electronic components of the greeting card bay be contained and concealed. The main opening or aperture 22 may be located in a center area of the core 16, as shown in the figures, although in other embodiments, the main opening or aperture 22 may be located elsewhere. A pocket or pouch 24 is attached to the rear surface of the core 16, beneath the sheet material 18, and surrounding the main opening or aperture 22, as shown in FIGS. 2, 4 and 5. The pocket or pouch 24, in one embodiment, may be made of a nylon fabric material, although any other type of material may be used. The pocket or pouch 24 attached to the rear surface of the core 16 and surrounding the main opening or aperture 22 therethrough, creates an open cavity into which an item, such as, in one embodiment, a gift card 14, may be inserted and removed. A gift card sleeve 15 may be attached to an inside surface of the pocket or pouch 24, as shown in FIGS. 2, 4 and 5. The gift card sleeve 15 is dimensioned to have a traditional sized gift card 14 inserted therein. A small gift or novelty item may be placed into the pouch 24 in addition to or in lieu of the gift card 14. Additionally, a plurality of foam elements 26 are attached to the front surface of the core 16, beneath the sheet material 18, and surrounding the main opening or aperture 22 and extending at least partially into the main opening or aperture 22. In one embodiment, as shown in FIGS. 1, 2 and 6, the foam elements 22 are triangular shaped and arranged in a square pattern over the main opening or aperture 22. The sheet material 18 or front surface of the core 16 of the greeting card 100 may contain printing and/or other embellishments that tie the sheet material 18 or front surface of the greeting card 100 and the plurality of foam elements 26 to the theme of the greeting card 100. For example, as shown in the figures, the front surface of the greeting card 100 contains printing indicating a game where the user may reach to the pouch 24 to retrieve a gift or prize. In another embodiment, the foam elements 26 could be shaped to represent the teeth of the shark and the pouch 24 would represent the inside of the shark's mouth. Different decorative combinations may be used which use the main opening or aperture 22 through the greeting card 100 as a mouth or opening of some sort. Instructions may be printed on the front surface of the card 100, instructing the user to reach into the opening for a fun surprise. While the plurality of elements 26 surrounding the opening on the front of the greeting card 100 are described herein as being foam, other materials may be used and are considered to be within the scope of the invention. These elements 26 may also be of any conceivable shape.

Figure 7:
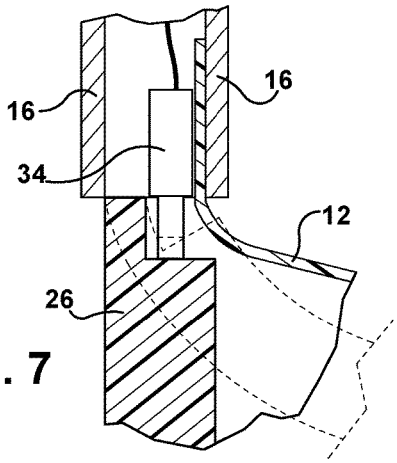
FIG. 7 is a cross-sectional view of a portion of the Greeting Card with Gift Card Holder Pouch of FIG. 6 from the perspective of arrows 7-7.

The greeting card 100 of the present disclosure and related inventions may additionally contain audio capabilities. A sound module may be contained within one or more minor openings or apertures in the core of the greeting card 100. The sound module may include, but is not limited to: an electronic circuit with integrated circuit chip and controller 28, a power source such as one or more batteries 30, a speaker 32, a memory device (may be part of integrated circuit chip) onto which at least one audio file is saved, a switch 34, various wires and circuitry which connect various components, and any other component which is required for or which facilitates special effects such as audio playback of the at least one audio file. In one embodiment, the switch 34 is a leaf switch which is located behind one of the plurality of foam elements 26 surrounding the main opening 22 on the front of the greeting card 100, as shown in FIGS. 6 and 7. In other embodiments, additional leaf switches 34 may be contain behind other of the plurality of foam elements 26. When a user reaches his/her hand into the pouch 24 to retrieve the gift card 14 or other gift item, as shown in FIG. 4, the plurality of foam elements 26 are pushed or thrust into the pouch 24, thereby moving the switch 34 from an "off" position to an "on" position and causing playback of the at least one audio file through the speaker 32. Removing one's hand from the pouch 24 allows the foam elements 26 to retract back to their original position, thereby moving the switch 34 back to the "off" position. Once the switch 34 is moved to the "on" position, the at least one audio file may play for a predetermined amount of time or until it has reached the end, or it may cease to play as soon as the user's hand is removed or the switch 34 retracts back to the "off" position. The at least one audio file may contain sounds, spoken word, music, singing, a movie clip, or any other recordable sound. In one embodiment, there may be a plurality of sound clips which each play in a particular order or series each successive time the switch is activated, or the sound clips may be randomly replayed. While the switch 34 has been described herein and shown in the figures as being a leaf switch, other types of switches may be used, such as, for example, an infrared switch, a motion sensitive switch, or any other type of switch.

In operation, the user receives the greeting card 100 and may open the greeting card 100 by pivoting the sentiment panel 20 away from the rest of the greeting card to read the sentiment or other matter written and/or printed thereon. The user may return to the front of the greeting card 100 where instructions are either printed on the front surface of the greeting card 100 or printed onto a sticker or label attached to the front surface of the greeting card 100 which instruct the user to reach into the greeting card 100 to retrieve a fun surprise. Upon reaching his/her hand into the aperture or opening 22 and pushing through the plurality of foam elements 26 attached around the aperture or opening 22, audio is played back through the speaker 32 and the user may retrieve the gift card 14 or other gift item which is contained within the pouch 24.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a greeting card body, a portion of the greeting card body having an aperture therethrough;

a pouch attached to a rear surface of the aperture on the greeting card body, creating an open cavity;

one or more objects blocking the open cavity;

a sound module attached to the greeting card which is operative to store and playback at least one audio file;

wherein placing one's hand into the open cavity, through the one or more objects blocking the open cavity, activates the sound module.

2. The greeting card of claim 1 further comprising a gift card located inside the pouch.

3. The greeting card of claim 1, wherein the pouch is made of a flexible, fabric material.

4. The greeting card of claim 3 further comprising a switch operative to control activation of the sound module.

5. The greeting card of claim 4, wherein the switch is a leaf switch.

6. The greeting card of claim 5, wherein the leaf switch is attached to the one or more objects blocking the open cavity.

7. The greeting card of claim 1, wherein the one or more objects blocking the open cavity are operative to flex or bend into the cavity.

8. The greeting card of claim 1, wherein the pouch is located between two inside panels of the greeting card body.

9. A greeting card comprising:

a greeting card body having a front surface, an inside left surface, an inside right surface and a rear surface;

an aperture which extends through the front and inside left surface of the greeting card body;

a pouch attached around the aperture beneath the inside left surface of the greeting card body;

a sound module contained within the greeting body, the sound module operative to store and playback at least one audio file;

one or more objects blocking an opening to the pouch;

a switch attached to the one or more objects blocking the pouch, the switch operative to control activation of the sound module.

10. The greeting card of claim 9, wherein placing one's hand into the pouch, through the one or more objects blocking the pouch, causes the switch to activate the sound module.

11. The greeting card of claim 9, wherein the pouch is made of a fabric material.

12. The greeting card of claim 9, wherein the switch is a leaf switch.

13. The greeting card of claim 9, wherein the one or more objects blocking the pouch are operative to flex into the pouch.

14. The greeting card of claim 9 further comprising a gift card located inside the pouch.

15. A greeting card comprising:

a greeting card body having an aperture contained through at least a portion thereof;

a pouch attached to a rear surface of the aperture;

at least one object blocking an opening to the pouch, the at least one object operative to flex into the pouch;

a sound module contained within the greeting card body, the sound module operative to store and playback at least one audio file;

wherein reaching into the pouch, through the at least one object blocking the opening to the pouch, activates the sound module.

16. The greeting card of claim 15, wherein the contents of the pouch can be accessed through a front surface of the greeting card.

17. The greeting card of claim 15 further comprising a gift card contained within the pouch.

18. The greeting card of claim 15, wherein the pouch is contained between to inside panels of the greeting card body.

19. The greeting card of claim 15 further comprising a switch attached to the at least one object blocking the opening of the pouch.

20. The greeting card of claim 19, wherein the switch is a leaf switch.

* * * * *